US007666067B2

(12) United States Patent
Jansson

(10) Patent No.: US 7,666,067 B2
(45) Date of Patent: Feb. 23, 2010

(54) METHOD AND DEVICE FOR SHARPENING A CUTTING TOOL

(75) Inventor: Torgny Jansson, Lindesberg (SE)

(73) Assignee: TJ Utveckling AB, Lindesberg (SE)

( * ) Notice: Subject to any disclaimer, the term of this patent is extended or adjusted under 35 U.S.C. 154(b) by 0 days.

(21) Appl. No.: 11/150,629

(22) Filed: Jun. 10, 2005

(65) Prior Publication Data

US 2005/0287934 A1 Dec. 29, 2005

(51) Int. Cl.
*B24B 7/00* (2006.01)

(52) U.S. Cl. ..... 451/193; 451/234; 451/241; 451/367; 451/371; 451/420

(58) Field of Classification Search ..... 451/45, 451/193, 229, 234, 241, 367, 368, 369, 371, 451/405, 419, 420
See application file for complete search history.

(56) References Cited

U.S. PATENT DOCUMENTS

| | | | | |
|---|---|---|---|---|
| 2,748,543 A | | 6/1956 | Pardee | |
| 3,368,310 A | | 2/1968 | Garvey | |
| 4,961,288 A | * | 10/1990 | Ketteringham | 451/224 |
| 5,301,473 A | * | 4/1994 | Seear | 451/367 |
| 5,527,208 A | * | 6/1996 | Blake et al. | 451/367 |
| 6,381,862 B1 | * | 5/2002 | Doman | 33/630 |
| 7,104,876 B1 | * | 9/2006 | Lin | 451/312 |
| 7,112,124 B1 | * | 9/2006 | Naples | 451/279 |
| 2006/0154576 A1 | * | 7/2006 | Hepworth | 451/45 |
| 2006/0211348 A1 | * | 9/2006 | Hyde et al. | 451/367 |

FOREIGN PATENT DOCUMENTS

| | | |
|---|---|---|
| DE | 1216150 B | 4/1962 |
| EP | 0225806 | 12/1986 |

* cited by examiner

*Primary Examiner*—Eileen P. Morgan
(74) *Attorney, Agent, or Firm*—Capitol City TechLaw

(57) ABSTRACT

A device for grinding a cutting tool uses a rotatable grindstone and a tool holder for mounting the cutting tool. The device guides the tool, mounted in the tool holder, along an intended plane, which is tangential to a peripheral surface of the rotatable grindstone, using a practically linear contact between the rotatable grindstone and the cutting tool. By moving the tool holder, with the mounted cutting tool, along the intended plane, this plane is transferred to an unbevelled side of the cutting tool.

17 Claims, 6 Drawing Sheets

METHOD AND DEVICE FOR SHARPENING A CUTTING TOOL

FIELD OF THE INVENTION

The present invention relates to a method for sharpening a profiled cutting tool with a substantially planar surface, e.g. cutting knives for a spindle moulder, shears for sheep, cattle and horses, as well as a device for implementing the above method.

PRIOR ART

Cutting knives for spindle moulders have a profiled cutting edge for milling a specific profile in a moulding, see FIG. 1*a*. The cutting knives are substantially planar on one side and have a bevel ground into the other side. This means that the edge angle ($\alpha$) is equal to the bevel angle ($\beta$), as can be seen in FIG. 1*b*. When the cutting tool becomes dull, it has to be resharpened. This can be achieved by using advanced grinding machines that can follow the profiled cutting edge, but this is very costly.

The cutting tool can also be resharpened by grinding the planar surface until a sharp edge is formed. This makes the cutting tool thinner, which means that a limited number of resharpenings may be carried out. Grinding the planar surface can be done on the planar side face of a slowly rotating wet grindstone. The large surface contact between the grindstone and the tool reduces the grinding pressure, however, and only polishing is de facto obtained. If, by some means, higher pressure is applied on the side face, uneven wear of the grindstone will result and this will render the grindstone unsuitable for future fettling of e.g. chisels or cutting blades for planes.

Large industrial machines may alternatively be used for grinding the planar surface, but these machines are also very expensive.

One way of increasing the speed of the grinding operation is to use a bench grinder with a rapidly rotating grindstone. This is not recommended, though, since the grindstone might burst from grinding on its planar side face, and the heat from the grinding may destroy the temper of the tool.

SUMMARY OF THE INVENTION

It is an object of the present invention to overcome the above-mentioned problems by providing a method with the steps of guiding the tool, mounted in the tool holder (200), along an intended plane which is tangential to a peripheral surface of the rotatable grindstone, using a practically linear contact between the rotatable grindstone and the cutting tool, and moving the tool holder, with the mounted cutting tool, along the intended plane for transferring said intended plane to an unbevelled side of the cutting tool.

By using the curved peripheral face of the grind-stone, the grinding pressure increases due to the small contact area. This method is preferably carried out on a slowly rotating wet grindstone, which does not make the tool overheat and lose its temper.

It is also an object of the present invention to provide a device for carrying out the above method. This is accomplished in that the grinding base comprises guiding means, adapted to guide the tool holder along an intended plane, and that the tool holder has matching surfaces for interacting with the guiding means of the grinding base.

BRIEF DESCRIPTION OF THE DRAWINGS

The invention will be described in further detail below with reference to the accompanying drawings, in which.

DETAILED DESCRIPTION OF THE DRAWINGS

The present invention is intended to be used in conjunction with a grinding machine, but this is per se not a part of the invention. References will be made to the grinding machine for illustrative purposes only. In order to describe the drawings, references will be made to upper, lower, right and left, but this is only for making it easier to interpret the figures.

Figure 1:
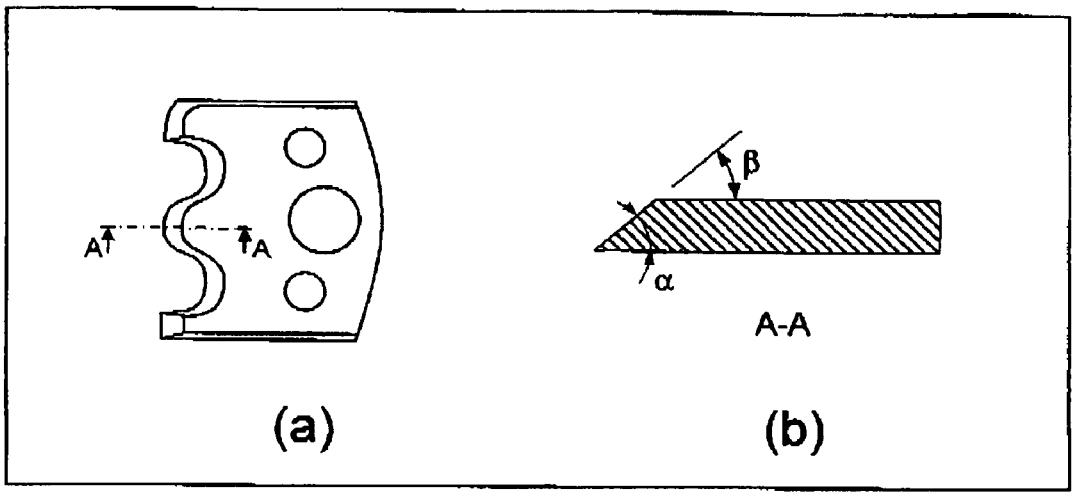
FIG. 1*a* is an example of a profiled moulder knife.
FIG. 1*b* is a sectional view of a cutting edge of said moulder knife.
Figure 2:
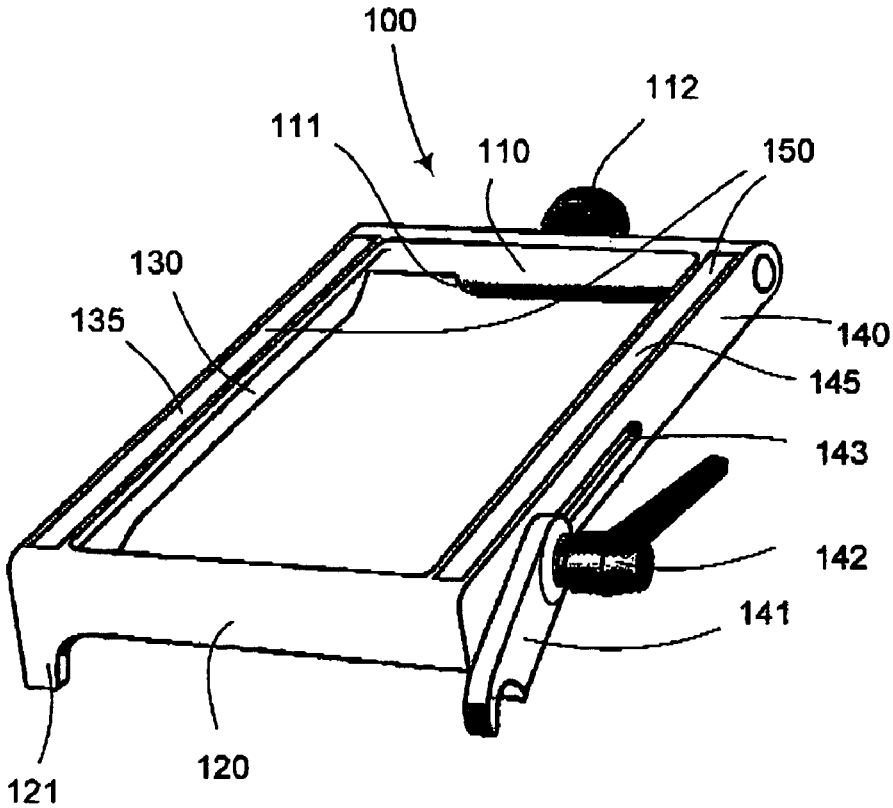
FIG. 2 is a perspective view of a grinding base of the present invention.

A grinding jig of the present invention comprises a grinding base 100 and a tool holder 200. The grinding base 100, see FIG. 2, comprises two crossbars 110, 120 and two beams 130, 140, which together form a generally rectangular frame. The upper crossbar 110 is formed from a hollow tube, which is halved lengthwise at the left side, forming a stop 111 on the bottom half. The upper crossbar 110 has, in the central part, further a threaded hole (not visible), where a base locking screw 112 is inserted.

The two beams 130, 140 extend in parallel from either end of the upper crossbar 110 down to the lower crossbar 120. The four parts (upper and lower crossbars 110, 120 and beams 130, 140) are rigidly joined in the corners in order to form a stable base or frame. The lower crossbar 120 is on the left side provided with a downwardly extending projection 121. The right beam 140 is provided with an optional arm 141, which is adjustable. The adjustable arm 141 is, at its upper end, attached to the right side of the right beam 140 with a locking screw 142, which is guided in a slot 143. The beams 130, 140 have upper guiding surfaces 135, 145, which are provided with pads 150 of a slick material, e.g. Teflon® (PTFE).

Figure 3:
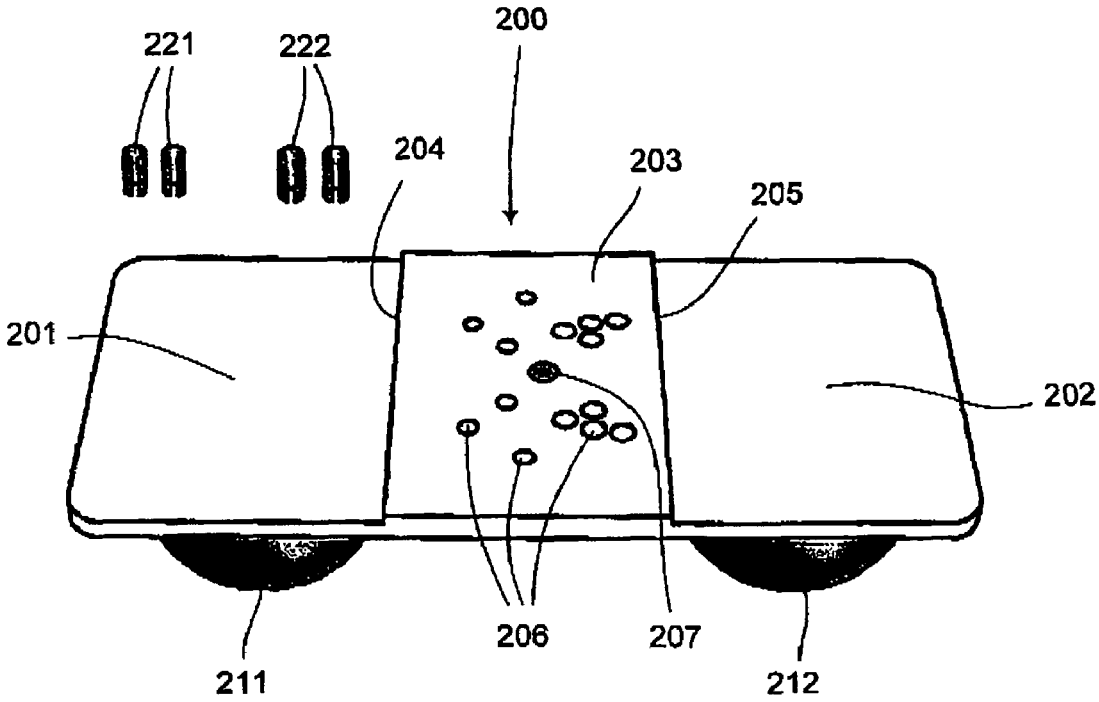
FIG. 3 is a perspective view of a tool holder of the present invention, together with some spring pins to be mounted thereon.

The tool holder 200 can be seen from below in FIG. 3. It has two sliding surfaces 201, 202 and a tool mount 203, formed as an elevated portion of the tool holder 200, where vertical sidewalls 204, 205 separate the sliding surfaces 201, 202 from the tool mount 203. The tool mount 203 is provided with a plurality of bores 206 of different diameter. The tool mount 203 is in the center further equipped with a powerful magnet 207. The tool holder is on the other side provided with two handles 211, 212, comprising vertically extending bolts fitted with plastic knobs. Spring pins 221, 222 of different diameter are provided to fit in the bores 206.

Figure 4:
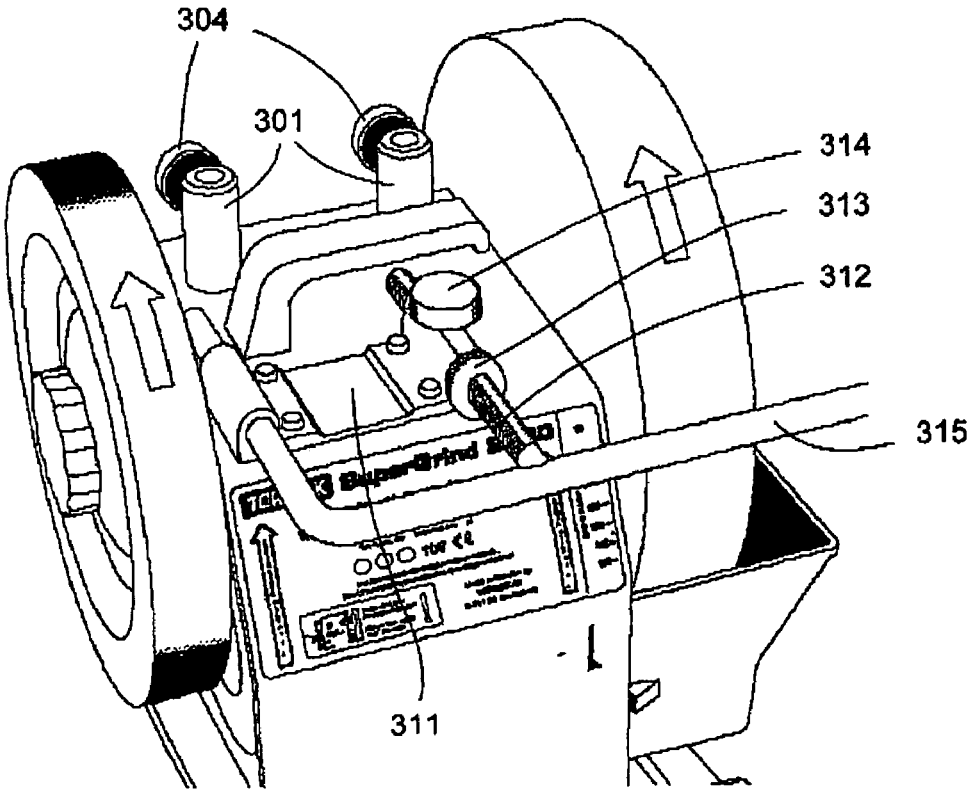
FIG. 4 is a perspective view showing a universal support mounted on a grinding machine.

The grinding machine can be equipped with universal supports 300, 310, see FIG. 4 where only one support 310 is mounted, for fitting various grinding accessories. The universal supports 300, 310 are mounted in special sockets 301, 311 that are provided on the grinding machine, for mounting the supports 300, 310 in a generally horizontal or vertical position. One leg 302, 312 of the universal support is threaded and a matching screw nut 303, 313 is threaded thereon for abutting the socket 301, 311. These screw nuts 303, 313 function as micro-adjust means. A locking screw 304, 314 is fitted in the socket 301, 311. A rod 305, 315 is attached to the legs 302, 312 and this rod 305, 315 extends past the grindstone or the honing wheel, depending on the orientation of the universal support 300, 310. A second leg is formed by bending the rod 305, 315 approx. 90 degrees, and this leg is also mounted in the socket 301, 311. The threaded leg 302, 312 is parallel to the second leg.

Figure 5:
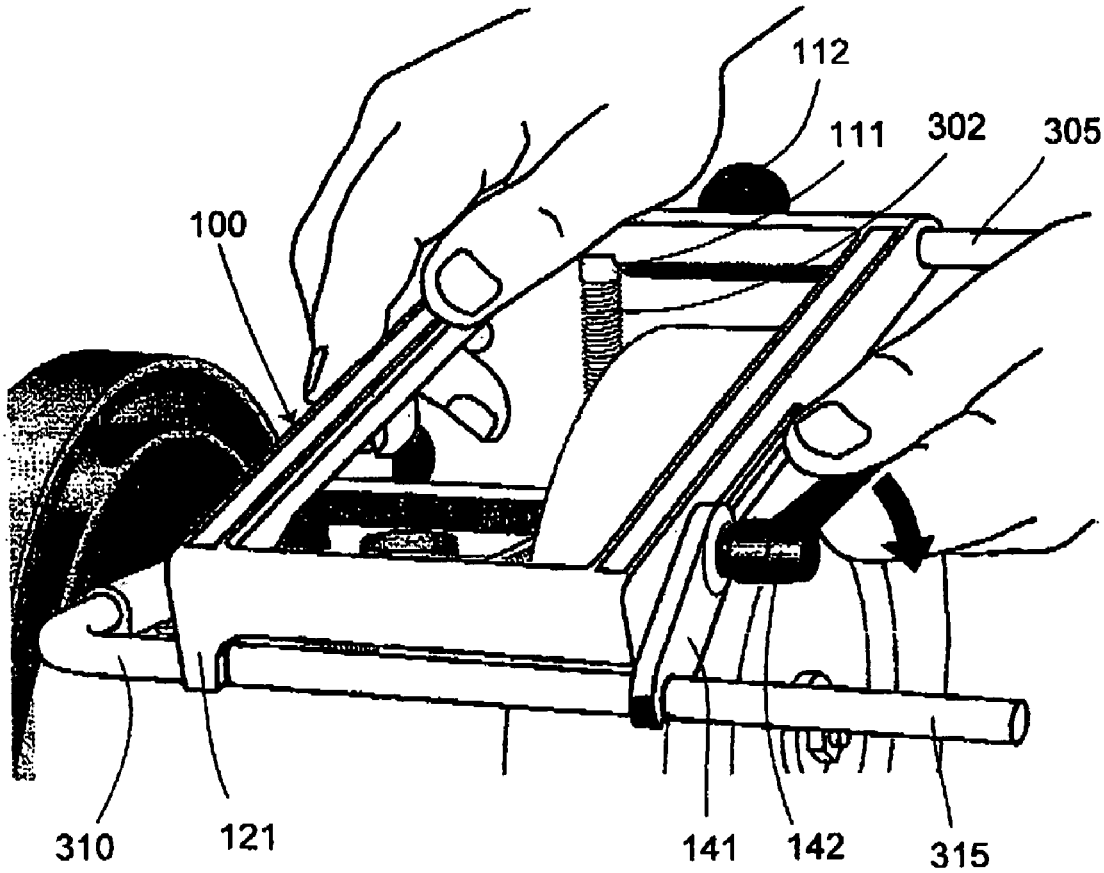
FIG. 5 is a perspective view showing an adjustable arm being placed on a horizontally mounted universal support.

The two universal supports 300, 310 are mounted in their corresponding sockets 310, 311, as shown in FIG. 5, and the grinding base 100 is mounted on the rod 305 of the generally vertically mounted universal support 300, by sliding the tubular upper crossbar 110 onto the rod 305. The base 100 is inserted until the stop 111 contacts the leg 302 of the universal support 300. The grinding base 100 is then pivoted until the projection 121 of the lower crossbar 120 comes in contact with the rod 315 of the generally horizontally mounted universal support 310 (see also FIG. 7). The projection 121 rests on the rod 315 and the adjustable arm 141 can be placed against the same rod 315, but must not be secured. The grinding base 100 is typically not centered over the grindstone, but is rather located slightly closer to the generally vertical leg 302 of the vertically mounted universal support 300. This reduces the free length of the rods 305, 315 and provides a more stable support.

Figure 6:
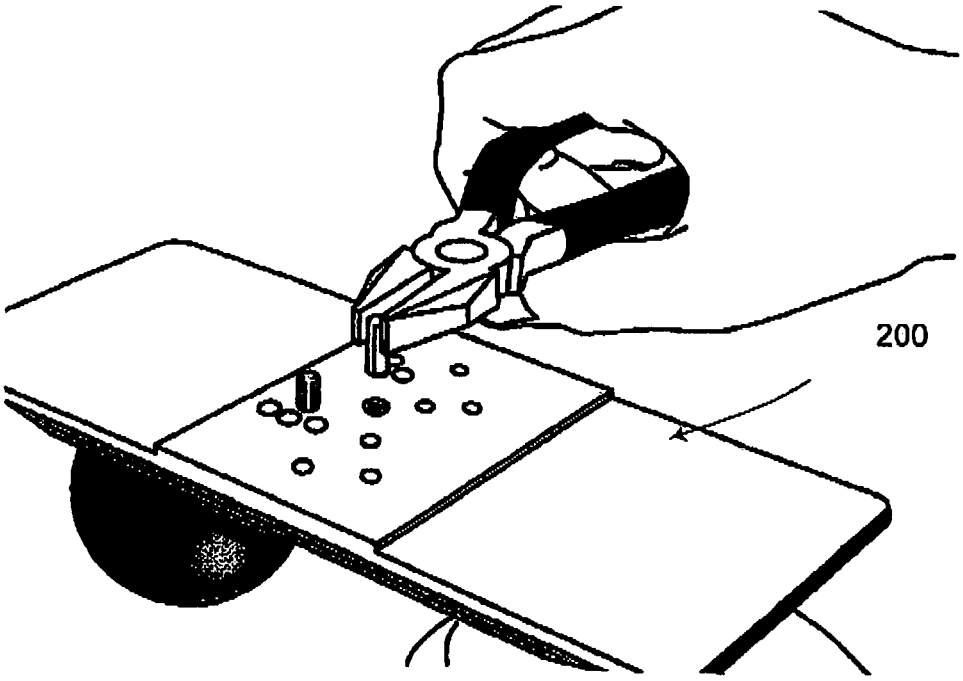
FIG. 6 is a perspective view showing how the spring pins are mounted in the tool holder.

The tool holder 200 is then prepared to accommodate the cutting tool. Spring pins 221, 222 are mounted in the bores 206 of the tool mount 203 to suit the hole configuration of the current cutting tool, see FIG. 6. The bores 206 in the tool mount 203 are arranged to fit the hole configuration of most cutting tools on the market. If an unusual tool shall be ground, additional bores 206 can be drilled by the user. The cutting tool is then mounted on the tool holder 200 with the help of the spring pins 221, 222 and the magnet 207. The magnet 207 holds the cutting tool in contact with the tool holder 200, while the spring pins 221, 222 prevent the cutting tool from moving and rotating. The holes in the cutting tool are typically 4 or 5 mm in diameter, and these are also the sizes of the used spring pins. The orientation of the tool on the tool holder is only important if the guiding surfaces 135, 145 of the grinding base 100 are not planar. Typically, the cutting tool is mounted with its cutting edge facing one of the short sides of the tool holder 200.

Figure 7:
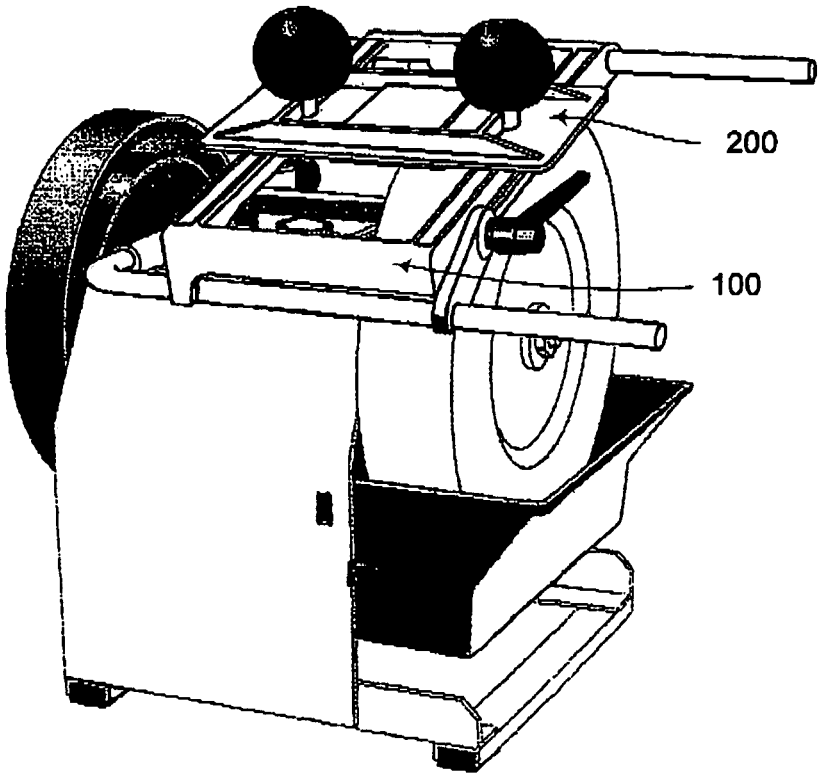
FIG. 7 is a perspective view showing the tool holder placed on the grinding base, and their relation to a grinding machine.

As can be seen in FIG. 7, the tool holder 200 is placed on top of the grinding base 100, with the sliding surfaces 201, 202 facing the pads 150 of slick material on the upper guiding surface 135, 145 of the beams 130, 140. Either universal support 300, 310 is thereafter adjusted with the micro-adjust means 303, 313 until a proper grinding depth is achieved, see FIG. 7, and the base 100 is then secured by tightening the base locking screw 112. The locking screw 142 of the adjustable arm 141 is finally tightened to ensure a stable engagement of the grinding base 100 on the two rods 305, 315 of the universal supports 300, 310, see FIG. 4. The adjustable arm 141 is formed with semi-circular notch and this prevents a separation between the universal supports 300, 310. This greatly enhances the rigidity of the entire assembly and less flexing occurs when the grinding base 100 is subjected to loading.

The grinding base 100 pivots about the rod 305 of the generally vertically mounted universal support 300. It rests on the rod 315 of the generally horizontally mounted universal support 310. The grinding position is approx. halfway between these points, and this means that a height adjustment at the projection 121 corresponds to an adjustment of the grinding depth with half of that amount.

The projection 121 of the grinding base 100 further forms a small angle with a plane of the horizontally mounted universal support 310. This means that a small adjustment of the horizontal displacement of the support rod 315 corresponds to a smaller increase in height relative to the grindstone for the projection 121. This represents an additional change ratio for altering the grinding depth. Tests have shown that turning the screw nut 313 (with a screw pitch of about 1.5 mm) a 1/7 of a turn corresponds to a change in grinding depth of 0.05 mm (50 micron), resulting in a total change ratio of about 4:1. The screw nuts 303, 313 can for this purpose be provided with a scale, which makes it easier to adjust the grinding depth.

Figure 8:
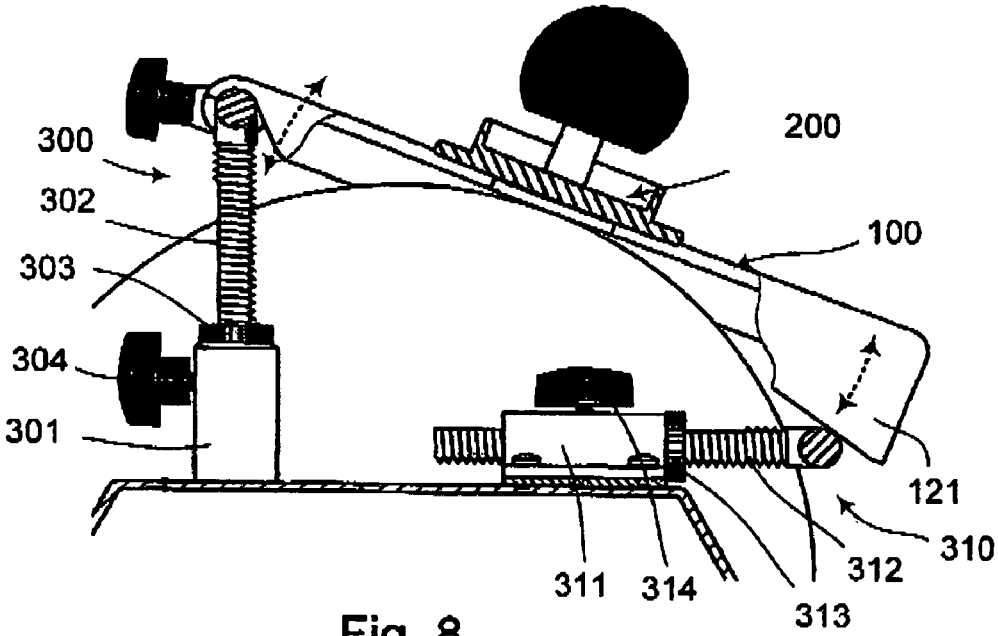
FIG. 8 is a side view in section showing how the universal supports are adjusted to control the grinding depth.
Figure 9:
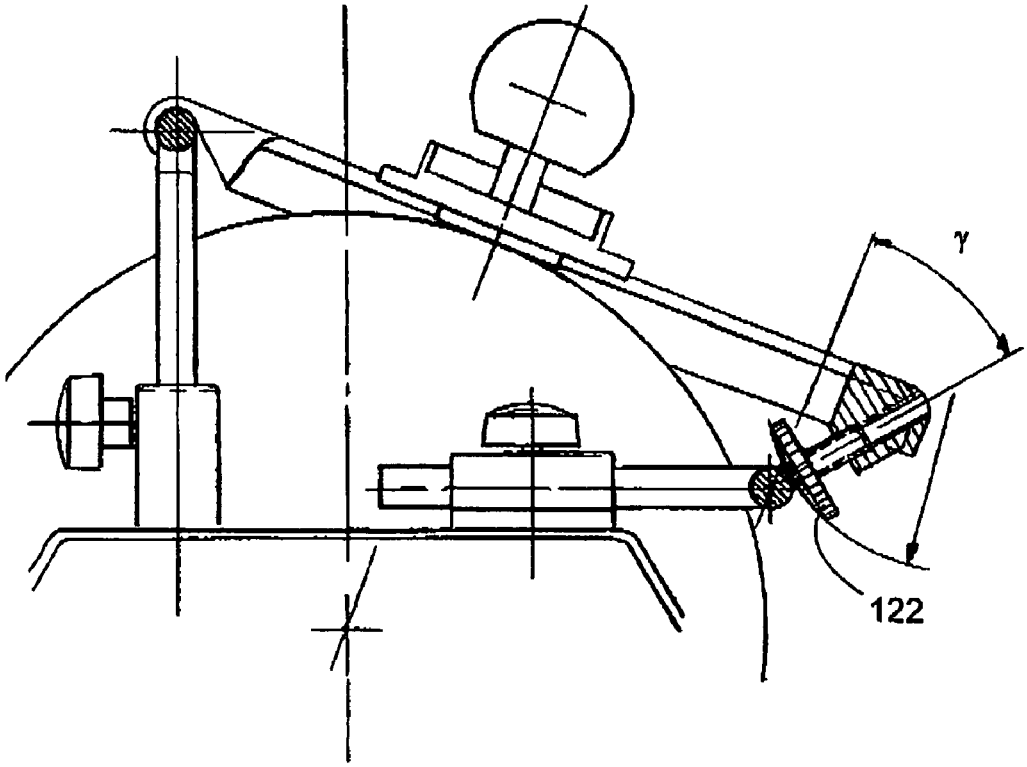
FIG. 9 is a side view in section showing an alternative embodiment for adjusting the grinding depth.

In FIG. 8, an alternative embodiment is shown for adjusting the grinding depth. The projection 121 is removed and an adjustable screw 122 is fitted in the lower crossbar 120. The contacting part of the head of the screw 122 is spherical. The screw 122 may be mounted at an angle $\gamma$ with a plane of the grinding base 100, which means that an adjustment of the screw translates into a finer adjustment of the grinding depth. One or several screws 122 can be fitted on the lower crossbar 120. In this case, no screw nut 303, 313 is needed on the upper 300 or lower 310 universal support for providing accurate adjustments.

When the grinding machine is switched on, only a very small portion of the tool is ground. In order to grind the entire tool, it must be moved over the grindstone. This is simplified by the pads 150 of slick material on the two beams 130, 140. The tool is moved sideways and forwards and backwards, until the entire surface has been ground. Since the grinding base is not centered over the grindstone, it may be necessary to rotate the tool holder half a turn, in a plane defined by the crossbars, in order to grind the final part. For large cutting tools, it may be necessary to loosen the base locking screw 112 and slide the grinding base 100 away from the threaded leg 302. The grinding base 100 is then secured in its new position by said locking screw 112. The guiding surface 135, 145 of the grinding base 100, defined by the beams 130, 140, has now been transferred to the cutting tool. Deburring can thereafter be performed on a honing wheel HW. The vertical sidewalls 204, 205 of the tool holder 200 protect the cutting edge of the cutting tool against contacting the guiding beams 130, 140.

The thickness of the cutting tool should not be reduced more than approx. 0.3 mm. A normal grinding depth is approximately 0.03-0.05 mm, meaning that the tool can be resharpened 6-10 times before it must be discarded.

The guiding surface 135, 145 of the grinding base 100 may also have a slightly curved shape, and the tool holder 200 may in this case be provided with additional guides for maintaining the orientation of the tool. The grinding base 100 can be mounted on the grinding machine, but can equally well be mounted on a separate structure. The lower crossbar 120 can optionally be formed with one, two or more fixed projections instead of one fixed projection 121 and one adjustable arm 141. The micro-adjust means 303, 313 in the disclosed embodiment is positioned on the legs 302, 312 of the universal supports 300, 310. These micro-adjust means 303, 313 may also be integral with the grinding base 100 and/or the tool holder 200 in order to obtain the same adjustability, e.g. such as shown in FIG. 8.

Figure 10:
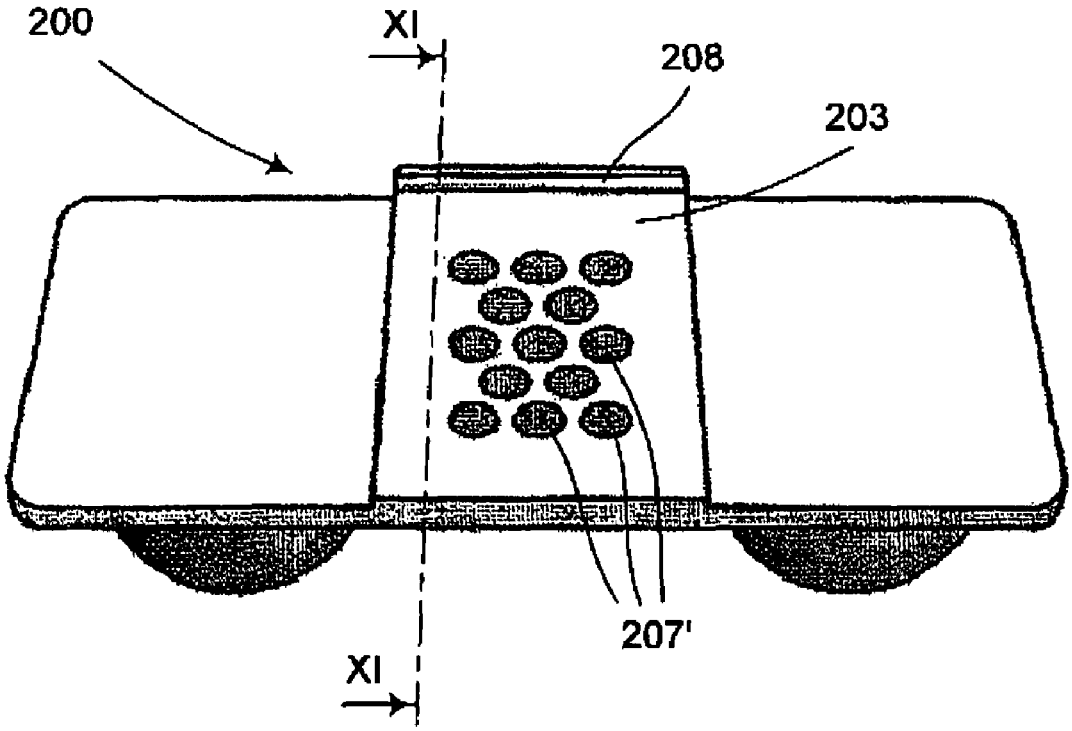
FIG. 10 is a side view of an alternative tool holder.
Figure 11:
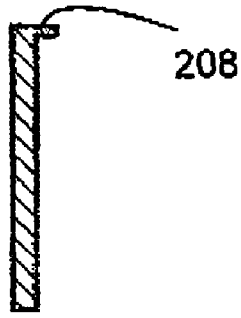
FIG. 11 is a view in cross-section of the tool holder in FIG. 10.

If the tool to be sharpened is not equipped with any holes, the tool holder 200 may be provided with a number of additional magnets 207', as shown in FIG. 10. These will more securely retain the tool against the tool holder 200 and make it possible to sharpen such a tool. The tool holder 200 may also be formed with one or two protruding edges or rims 208 on the tool mount 203, for preventing the tool from sliding due to the grinding force, and one such rim 208 can be seen in cross-section in FIG. 11. If two rims are provided, they are located at opposite sides of the tool mount. This is beneficial for small tools since the two rims 208 make it possible to grind from two directions. This enables turning of the tool by turning the tool holder 200. If two rims 208 are provided and the tool is too large to fit therebetween, the user may grind off one of the rims 208 with the help of the present invention.

The present invention is described for grinding a moulder knife, but it can be used with various profiled cutting tools having a substantially planar surface and the cutting edge ground into the opposite side.

The spirit of the present invention can be achieved by any structure, which enables a cutting tool to be supported along a planar or curved surface, for grinding on the peripheral face of a grindstone and thus transferring the shape of said surface onto the cutting tool. The guiding surfaces 135, 145 guides the cutting tool so that the surface to be ground moves in a plane which is tangential to the peripheral face of the grindstone.

The invention claimed is:

1. A device for sharpening a profiled cutting tool, the device comprising: a grinding base, wherein the grinding base is attached to a support device mounted on a grinding machine, the support device including two opposed support members extending from the grinding machine, whereby the grinding base is removably attached to the support members at two opposing ends of the grinding base, the two opposing ends of the grinding base connected by two additional opposing members that straddle the periphery of a grinding stone when the grinding base is mounted to the support members, wherein the two additional members of the grinding base comprise guiding means with guiding surfaces, and a tool holder for holding a cutting tool, wherein the guiding surfaces are adapted to guide the tool holder in an intended plane tangential to the peripheral face of the grinding stone, and the tool holder has surfaces for interacting with the guiding surfaces of the guiding means of the grinding base.

2. The device according to claim 1, further comprising:

micro-adjust means on the support device for accurately adjusting the position of the cutting tool relative to the grinding machine.

3. The device according to claim 1, further comprising:

micro-adjust means on the support device for accurately adjusting the position of the guiding means relative to the grinding machine.

4. The device according to claim 2, wherein the micro-adjust means comprises a threaded leg of universal supports of the support device and a screw nut screwed on to said leg.

5. The device according to claim 4, wherein the screw nut of the micro-adjust means to be screwed on to the threaded legs of the universal support are provided with a scale for simplifying accurate adjustment of the grinding depth.

6. The device according to claim 2, wherein a projection of the grinding base forms an angle with the plane of a horizontal mounted universal support which is smaller then 45 degrees, resulting in a change ration between the adjustment of said universal support and the change in grinding depth.

7. The device according to claim 3, wherein the micro-adjust means comprises a threaded leg of universal supports of the support device and a screw nut screwed on to said leg.

8. The device according to claim 7, wherein the screw nut of the micro-adjust means to be screwed on to the threaded legs of the universal support are provided with a scale for simplifying accurate adjustment of the grinding depth.

9. The device according to claim 3, wherein a projection of the grinding base forms an angle with the plane of a horizontal mounted universal support which is smaller then 45 degrees, resulting in a change ration between the adjustment of said universal support and the change in grinding depth.

10. The device according to claim 1, wherein the shape of the guiding means of the grinding base is planer.

11. The device according to claim 1, wherein the grinding base is provided with an adjustable arm to ensure that the grinding base is fully supported on the support device of the grinding machine, irrespective of manufacturing tolerances of universal supports.

12. The device according to claim 1, wherein the guiding means is provided with a slick material for simplifying the movement of the tool holder.

13. The device according to claim 12, wherein the slick material is PTFE of Teflon®.

14. The device according to claim 1, wherein the tool holder is provided with a magnet for retaining the cutting tool on the tool holder.

15. The device according to claim 1, wherein the tool holder is provided with a plurality of bores where spring pins can be mounted for securing one of a variety of different cutting tools on the tool holder.

16. The device according to claim 1, wherein the tool holder is provided with vertical sidewalls which protect a cutting edge of the cutting tool during the grinding operation.

17. The device according to claim 1, wherein the tool holder is provided with a protruding edge or rim for retaining the tool on a tool mount.

* * * * *